US007553000B2

(12) United States Patent
Katayama

(10) Patent No.: US 7,553,000 B2
(45) Date of Patent: Jun. 30, 2009

(54) INK-JET PRINTER, HEAD FOR INK-JET PRINTER AND FLEXIBLE CABLE USABLE FOR THE SAME

(75) Inventor: Naoki Katayama, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 518 days.

(21) Appl. No.: 11/493,485

(22) Filed: Jul. 27, 2006

(65) Prior Publication Data

US 2007/0024677 A1 Feb. 1, 2007

(30) Foreign Application Priority Data

Jul. 28, 2005 (JP) ..... 2005-218995

(51) Int. Cl.
*B41J 2/14* (2006.01)
*B41J 2/16* (2006.01)

(52) U.S. Cl. ..... 347/50; 347/68

(58) Field of Classification Search ..... 347/50, 347/57–59, 68, 70, 71
See application file for complete search history.

(56) References Cited

U.S. PATENT DOCUMENTS 7,004,565 B2 2/2006 Suzuki et al.
7,434,914 B2 * 10/2008 Ito ..... 347/50
2004/0060969 A1 4/2004 Imai et al.

FOREIGN PATENT DOCUMENTS

| | | |
|---|---|---|
| JP | 2003311953 | 11/2003 |
| JP | 2004114609 | 4/2004 |
| JP | 2004328973 | 11/2004 |

* cited by examiner

*Primary Examiner*—Juanita D Stephens
(74) *Attorney, Agent, or Firm*—Baker Botts L.L.P.

(57) ABSTRACT

A head, for an ink-jet printer, includes a channel unit having a plurality of elongated pressure chambers arranged in a plurality of pressure-chamber rows; an actuator unit having individual surface electrodes corresponding to the pressure chambers respectively, and land portions each of which is conducted to one of the individual surface electrodes; and a flexible cable having connection terminals and signal lines. The land portions are electrically connected to the connection terminals. In each of the pressure-chamber rows, the land portions are arranged such that a certain land portion of the land portions is shifted, in the longitudinal direction of the pressure chamber, from another land portion adjacent to the certain land portion. Accordingly, it is possible to easily connect the flexible cable and the actuator unit easily even when the pressure chambers are arranged highly densely.

20 Claims, 11 Drawing Sheets

INK-JET PRINTER, HEAD FOR INK-JET PRINTER AND FLEXIBLE CABLE USABLE FOR THE SAME

CROSS REFERENCE TO RELATED APPLICATION

The present application claims priority from Japanese Patent Application No. 2005-218995, filed on Jul. 28, 2005, the disclosure of which is incorporated herein by reference in its entirety.

BACKGROUND OF THE INVENTION

1. Field of the Invention

The present invention relates to an ink-jet printer, a head for ink-jet printer and a flexible cable usable for the same.

2. Description of the Related Art

As an ink-jet printer which performs recording on a recording medium by discharging an ink, there is an ink-jet printer which is hitherto widely known and which is provided with a cavity unit which has a plurality of nozzles, a plurality of pressure chambers communicating with the nozzles respectively, and a manifold temporarily storing an ink to be supplied to the pressure chambers; and an actuator unit which has a plurality of individual electrodes formed corresponding to the pressure chambers, respectively, and which supplies driving voltage to the individual electrodes so as to change volume of the pressure chambers corresponding to the individual electrodes, respectively, thereby discharging the ink from the nozzles.

As such an ink-jet printer, an ink-jet printer is known which has individual surface electrodes, auxiliary electrodes (land portions, adhesion land portions or weld land portions) electrically conducted to the individual surface electrodes respectively and not overlapping in a plan view with the pressure chambers respectively; and in which the auxiliary electrodes are aligned in rows in one direction to be connected to connection pads (connection terminal portions), respectively, of signal lines of a flexible cable (see, for example, FIGS. 10A to 10D of U.S. Pat. No. 7,004,565 which correspond to FIGS. 10(*a*) to 10(*d*) of Japanese Patent Application Laid-open No. 2003-311953).

In the recent years, in an ink-jet printer, there is an attempt to miniaturize the head and to highly densify the nozzles (to arrange the nozzles highly densely) in response to the demand for high-speed printing and improvement of printed image and/or letter. For this purpose, it is demanded to make the pitch of nozzles as narrow as possible. In the ink-jet head described in U.S. Pat. No. 7,004,565, however, there is a problem that in a flexible cable (FPC, COF or COP) used for connecting the individual surface electrodes of the actuator unit to a control board, signal lines (a conductive pattern formed on a flexible and insulative substrate), connected to the land portions corresponding to the individual surface electrodes, respectively, are concentrated (congested) on a side of the flexible cable at which the signal lines are drawn, thereby increasing the number of signal lines on this side of the flexible cable. Accordingly, the wiring (line) pitch of the signal lines (conductive pattern) becomes narrow and thus it is difficult to realize a miniaturized head and densified nozzles (nozzles which are arranged highly densely).

Further, there is also known an individual surface electrode having a driving portion overlapping in a plan view with a pressure chamber and a land portion conducted to the drive portion and not overlapping in a plan view with the pressure chamber (see, for example, FIG. 1 of Japanese Patent Application Laid-open No. 2004-328973).

Even if providing such a land portion, however, the wiring pitch of the signal lines in the flexible cable is still narrow.

Furthermore, there has been proposed a wiring structure in which head terminals, arranged on and conducted to surface electrodes, respectively, of the ink-jet head, are arranged in a staggered manner, thereby arranging terminal electrodes, which are connected to the head terminals respectively, also in a staggered manner (see, for example, FIG. 4 of U.S. Patent Application Publication No. US 2004/0060969 A1 corresponding to FIG. 4 of Japanese Patent Application Laid-open No. 2004-114609).

However, even when the head terminals of the surface electrodes and the terminal electrodes of the flexible cable in the ink-jet head are formed in a staggered manner, as in the wiring construction described in U.S. Patent Application Publication No. US 2004/0060969 A1, the sizes of the head terminals and terminal electrodes cannot be reduced substantially for the following reason. That is, when electrically connecting the head terminals to the terminal electrodes by soldering, it is necessary to ensure the electrical connection between the head terminals and the terminal electrodes. However, when the sizes of the head terminals and the terminal electrodes are reduced to be small, there is a fear that the electrical connection cannot be performed successfully if the head terminals and/or the terminal electrodes are deviated from (moved out of) their positions even by a small amount while performing the connection. Therefore, in such a wiring construction, the pitch of the signal lines of the flexible cable is still narrow, which in turn makes it difficult to further arrange the nozzles highly densely.

In order to advance the further densification of the nozzles and to increase the number of the individual surface electrodes, it is necessary to use a plurality of flexible cables (for example, FPC or COP). However, the increase in the number of flexible cables not only weakens the mechanical strength of the wiring connection considerably but also increase the production cost.

SUMMARY OF THE INVENTION

An object of the present invention is to provide a head for an ink-jet printer, which is provided with densely arranged nozzles and which is electrically connectable to an actuator adopted to correspond to the densely arranged nozzles without using a plurality of flexible cables; a flexible cable usable for connection with the head for the ink-jet printer; and an ink-jet printer provided with the flexible cable.

According to a first aspect of the present invention, there is provided a head for ink-jet printer which discharge an ink, the head including:

a cavity unit including a plurality of nozzles, a plurality of elongated pressure chambers communicating with the nozzles respectively, and a manifold storing the ink to be supplied to the pressure chambers;

an actuator unit having individual surface electrodes which are formed corresponding to the pressure chambers, respectively, electrode-drawing portions which are drawn in a longitudinal direction of the pressure chambers respectively and are conducted to the individual surface electrodes respectively, and land portions which are conducted to the electrode-drawing portions respectively, the actuator changing volume of the pressure chambers respectively, when driving signal is supplied to the individual surface electrodes, so as to discharge the ink from the nozzles; and a flexible cable arranged to overlap with the actuator unit, and having a flexible and insulative substrate, a plurality of connection terminals formed on the substrate, and signal lines formed on the substrate and drawn from the connection terminals respectively; wherein:

the land portions are electrically connected to the connection terminals, respectively; and three land portions, among the land portions, adjacent to one another in a short direction of the pressure chambers and on a signal-line drawn side at which the signal lines are drawn, are arranged to shift from one another in the longitudinal direction of the pressure chambers. Here, the term "on the signal-line drawn side" is intended to also include a case in which land portions (adhesion land portions, weld land portions), which are other than the land portion on the signal-line drawn side, are not shifted in the longitudinal direction of the pressure chambers.

Accordingly, the land portions and the pressure chambers corresponding to the individual surface electrodes respectively are consequently separated, thereby eliminating the fear that solder and/or paste flow and enter into areas of the actuator unit, the areas overlapping with the pressure chambers respectively and being deformable areas of the actuator unit.

Further, since a certain land portion is shifted, in the longitudinal direction of the pressure chamber, from another land portion which is adjacent to the certain land portion, the distance (spacing distance) between the land portions is wider than in a case in which the land portions are aligned in a horizontal row (for example, in the short direction of the pressure chambers). Accordingly, on the side at which the signal lines are drawn (the signal-line drawn side), at which the wiring pitch of the signal lines is the narrowest, the signal lines formed as a conductive pattern can be wired, in a non-tight or non-narrow manner (without making the signal lines arranged very narrowly or tightly), between the connection terminals, of the flexible cable, which are to be electrically connected to the land portions. Therefore, without using a plurality of flexible cables (for example, FPC, COP, COF or the like), it is possible to electrically connect the land portions, of the actuator, formed corresponding to the densely arranged pressure chambers, to the connection terminals of the flexible cable, in an easy and inexpensive manner.

In the head for the ink-jet printer of the present invention, the pressure chambers may form a plurality of pressure-chamber rows linearly aligned in a row-direction which is different from the longitudinal direction; and the land portions may be arranged such that, a land portion, among the land portions, which is conducted to an individual surface electrode among the individual surface electrodes and corresponding to a pressure chamber forming a pressure-chamber row among the pressure-chamber rows and being on the signal-line drawn side, is arranged at a position shifted in the longitudinal direction from another land portion conducted to another individual surface electrode corresponding to another pressure chamber which is adjacent to the pressure chamber and which also forms the pressure-chamber row on the signal-line drawn side.

Accordingly, at least in the pressure-chamber row on the signal-line drawn side, a land portion, which is conducted to an individual surface electrode corresponding to a certain pressure chamber belonging to the pressure-chamber row, is arranged at a position shifted, in the longitudinal direction of the pressure chamber, from another land portion conducted to another individual surface electrode corresponding to an adjacent pressure chamber to the certain pressure chamber in the row. Therefore, the spacing distance between the land portions becomes wider than in a case in which the land portion are aligned immediately lateral to one another (for example, in the short direction of the pressure chamber).

In the head for the ink-jet printer of the present invention, electrostatic capacitance of the electrode-drawing portions may be same among the electrode-drawing portions. Here, the term "electrostatic capacitance of the electrode-drawing portions" means electrostatic capacitance generated due to the electrode-drawing portions, and that "electrostatic capacitance of the electrode-drawing portions is same among the electrode-drawing portions" means that areas (area dimensions) in a plan view of the electrode-drawing portion are same among the individual surface electrodes.

Accordingly, when area dimensions of the individual surface electrodes are same among the individual surface electrodes in a plan view, and when and area dimensions of the land portions are same among the land portions in a plan view, since the electrode-drawing portions are formed to have the same area dimension among the electrode-drawing portions, the electrostatic capacitance becomes same among the electrodes each including one of the individual surface electrodes, one of the land portions and one of the electrode-drawing portions, thereby making it easy to control the waveform.

In the head for the ink-jet printer of the present invention, a length, in the longitudinal direction of the pressure chambers, of the electrode drawing portions may be same among the electrode drawing portions.

Accordingly, by forming the electrode drawing portions to have a same length in the longitudinal direction of the pressure chamber, it is possible to easily make the electrostatic capacitance to be same in the electrode drawing portions.

In the head for the ink-jet printer of the present invention, the land portions may form a plurality of land portion groups which are adjacent to each other and each of which includes land portions adjacent to one another; and an arrangement pattern, in which the land portions are arranged, may be same among the land portion groups.

Accordingly, by dividing land portions corresponding to pressure chambers within a pressure chamber row into land portion groups and by repeating the same arrangement pattern for each of the groups, it is possible to simplify the arrangement of the land portions to be connected to the connection terminals of the flexible cable (signal lines).

In the head for the ink-jet printer of the present invention, the electrode drawing portions, extending from the individual surface electrodes respectively, may be parallel to one another; and the land portions, included in each of the land portion groups, may be arranged along a straight line inclined with respect to the longitudinal direction of the pressure chambers.

Accordingly, by arranging the land portions on a straight line inclined with respect to the longitudinal direction of the pressure chambers, the spacing distance between the land portions becomes wide. This consequently widens the spacing distance between the connection terminals arranged corresponding to the land portions, respectively, it is possible to arrange or draw the signal lines of the flexible cable in a non-narrow manner (with enough space).

In the head for the ink-jet printer of the present invention, the electrode drawing portions, extending from the individual surface electrodes, respectively, may be parallel to one another; the land portions included in each of the land portion groups may be arranged one by one at a constant spacing distance in the longitudinal direction of the pressure chambers; a spacing distance in the longitudinal direction of the pressure chambers may be widest between land portions among the land portions and located at both ends, respectively, in each of the land portion groups, and remaining land portions, except for the land portions located at the both ends, may be arranged to deviate from a straight line connecting the land portions located at the both ends in each of the land portion groups.

Accordingly, the spacing distance between two land portions, located at the both ends, respectively, in each of the land portion groups, becomes the widest in each of the groups, and thus the signal lines of the flexible cable can be wired or drawn in a non-narrow manner. In addition, the remaining land portions, other than the two land portions located at the both ends in each of the land portion groups, are arranged to deviate, from a straight line connecting the two land portions located at the both ends, in a direction orthogonal to the longitudinal direction of the pressure chambers. Accordingly, upon electrically connecting the connection terminals of the flexible cable and the land portions of the actuator unit, it is possible to press the flexible cable and the actuator unit in a balanced manner.

In the head for the ink-jet printer of the present invention, the land portions, included in each of the land portion groups, may be arranged one by one at a spacing distance in the longitudinal direction of the pressure chambers; and the spacing distance may be widest among land portions in a land portion group among the land portion groups and disposed on the signal-line drawn side.

Accordingly, in the position (group) at the outermost side which is the signal-line drawn side, the spacing distance among the land portions included in this group becomes the widest. This is particularly advantageous when the wiring pitch becomes narrow at the outermost position.

In the head for the ink-jet printer of the present invention, the row-direction of the pressure-chamber rows may be orthogonal to the longitudinal direction of the pressure chambers; and a direction in which the signal lines are drawn may be parallel to the longitudinal direction of the pressure chambers.

Accordingly, since the signal lines are drawn in parallel to the longitudinal direction of the pressure chambers, the construction of the flexible cable is simplified, and the production becomes easy.

In the head for the ink-jet printer of the present invention, the pressure chambers may include color-designated (color-specific) pressure chambers to which a plurality of color inks are supplied respectively, the color inks including a black ink; and the black ink may be supplied to a color-designated pressure chamber among the color-designated pressure chambers and corresponding to an individual electrode among the individual electrodes and being on the signal-line drawn side.

The length of the pressure chamber(s) for the black ink, for which a large ink discharge amount is required, generally has a length greater than that of other pressure chamber(s) for other color(s) other than black for purpose of the stable ink discharge. In such a case, the length of the individual surface electrode formed corresponding to the pressure chamber for the black ink is also greater than other individual electrode(s) corresponding to the pressure chamber(s) for other color(s). Since the length of the individual electrode corresponding to the pressure chamber for the black ink can be great, the wiring pitch for the signal lines of the flexible cable can be secured with leeway or in a non-narrow manner.

In the head for the ink-jet printer of the present invention, the cavity unit may include a plurality of metallic plates joined together by metal diffusion bonding.

Accordingly, since the cavity unit is made of metallic plates, it is possible to apply the cavity unit in a case in which the actuator is formed by calcinating a piezoelectric ceramics.

In the head for the ink-jet printer of the present invention, the electrode drawing portions may be arranged at positions overlapping with the manifold.

Accordingly, when, for example, a large number of plates are heated under a high-pressure state to perform the metal diffusion bonding for the plates, the manifold is arranged at a position away or separated from portions which are deformed (deformable areas) to apply pressure to the pressure chambers. By such an arrangement, although the width of the head is greater, it is possible to ensure the joining between the plates with respect to the portions affecting the discharge (jetting) of the ink. In addition, by arranging the electrode-drawing portions, at which the land portions to be connected to the flexible cable are formed respectively, away from the areas overlapping with the pressure chambers respectively, it is possible to obviate the interference, of the flexible cable with the deformable areas, which would otherwise affect the ink discharge.

In the head for the ink-jet printer of the present invention, the actuator unit may further include inner electrodes formed above the pressure chambers, respectively, and piezoelectric sheets each formed on a surface of one of the inner electrodes; and each of the individual surface electrodes may be formed on a surface of one of the piezoelectric sheets.

The actuator unit applies pressure to the pressure chambers by the deformation of the actuator (actuator sheets) as a whole. When the signal lines of the flexible cable are connected, with solder, directly to the individual surface electrodes formed on the piezoelectric sheets, the rigidity of the soldered portions becomes great, and the piezoelectric sheets are difficult to be deformed. In the present invention, however, the land portions are arranged at areas which are between the individual surface electrodes and separated from the deformable or deforming portions. Accordingly, there is no fear that the land portions affect the pressure application to the pressure chambers by the deformation of the piezoelectric sheets.

In the head for the ink-jet printer of the present invention, with respect to all of the land portions, three land portions among the land portions and adjacent to one another in the short direction of the pressure chambers may be arranged to shift from one another in the longitudinal direction of the pressure chambers. In this case, the degree of freedom in arranging (drawing) the signal lines of the flexible cable becomes higher than in a case that, with respect only to the land portions on the signal-line drawn side at which the signal lines are drawn, three land portions adjacent to one another in the short direction of the pressure chambers, are arranged to be shifted from one another in the longitudinal direction of the pressure chambers.

In the head for the ink-jet printer of the present invention, with respect to land portions among the land portions and on the signal-line drawn side, four land portions which are adjacent to one another in the short direction of the pressure chambers may be arranged to shift from one another in the longitudinal direction of the pressure chambers. In this case, the wiring pitch of the signal lines of the flexible cable can be wider than in a case that only three land portions, among the land portions, which are adjacent to one another in the short direction of the pressure chambers and on the signal-line drawn side, are arranged to shift from one another in the longitudinal direction of the pressure chambers.

The head for the ink-jet printer of the present invention may include only one piece of the flexible cable. In this case, since the head does not use a plurality of flexible cables, it is possible to enhance the reliability of the electrical connection and mechanical connection between the land portions and connection terminals.

According to a second aspect of the present invention, there is provided a flexible cable connectable to an head for an ink-jet printer, the head including: a cavity unit including a plurality of nozzles, a plurality of elongated pressure chambers communicating with the nozzles respectively, and a manifold storing an ink to be supplied to the pressure chambers; and an actuator unit having individual surface electrodes which are formed corresponding to the pressure chambers, respectively, electrode-drawing portions which are drawn in a longitudinal direction of the pressure chambers respectively, and are conducted to the individual surface electrodes, respectively, and land portions which are conducted to the electrode-drawing portions, respectively, the actuator changing volume of the pressure chambers respectively, when driving signal is supplied to the individual surface electrodes, so as to discharge the ink from the nozzles, the flexible cable including:

a flexible and insulative substrate which is band-shaped;

a plurality of connection terminals which are formed on the substrate; and a plurality of signal lines formed on the substrate and drawn, in an extending direction in which the substrate extends, from the connection terminals respectively, the signal lines supplying driving signal to the individual surface electrodes respectively;

wherein three connection terminals, among the connection terminals, which are adjacent to one another in a direction different from the extending direction and arranged in the substrate on a signal-line drawn side at which the signal lines are drawn, are formed at positions shifted from one another in the extending direction.

Accordingly, since at least in the three connection terminals on the signal-line drawn side, a certain connection terminal which corresponds to a certain land portion on the signal-line drawn side and connection terminals which are at both ends of the certain connection terminal and which correspond to the land portions at the both ends of the certain land portion on the signal-line drawn side are located at positions shifted from one another in the direction different from the extending direction (for example, longitudinal direction of the pressure chambers), it is possible to widen the spacing distance between the connection terminals, and the signal lines of the flexible cable can be wired (drawn) in a non-narrow manner.

In the flexible cable connectable to the head for the ink-jet printer of the present invention, each of the connection terminals may be a copper-foil portion formed with a through hole at a center of the copper-foil portion.

Accordingly, it is possible to electrically connect the connection terminals and the land portions respectively in a easy manner by filling solder or the like in the through hole formed in the center of the copper-foil portion.

According to a third aspect of the present invention, there is provided an ink-jet printer which discharges an ink to perform recording on a recording medium, the ink-jet printer including:

a head for ink-jet printer which includes a cavity unit having a plurality of nozzles, a plurality of elongated pressure chambers communicating with the nozzles, respectively, and a manifold storing the ink to be supplied to the pressure chambers; an actuator unit which has individual surface electrodes formed corresponding to the pressure chambers, respectively, electrode-drawing portions drawn in a longitudinal direction of the pressure chambers, respectively and conducted to the individual surface electrodes, respectively, and land portions conducted to the electrode-drawing portions, respectively, the actuator changing volume of the pressure chambers respectively when driving signal is supplied to the individual surface electrodes so as to discharge the ink from the nozzles; and a flexible cable arranged to overlap with the actuator unit and having a flexible and insulative substrate, a plurality of connection terminals formed on the substrate, and signal lines formed on in the substrate and drawn from the connection terminals, respectively;

a carriage which is movable while supporting the head for ink-jet printer; and a drive control unit which is connected to one end of the flexible cable, which supplies the driving signal to the individual surface electrodes, and which supplies a signal for controlling drive of the carriage to the carriage;

wherein the land portions are electrically connected to the connection terminals, respectively; and three land portions, among the land portions, which are adjacent to one another in a short direction of the pressure chambers and on a signal-line drawn side at which the signal lines are drawn, are arranged to shift from one another in the longitudinal direction of the pressure chambers.

According to the third aspect of the present invention, the land portions and the pressure chambers corresponding to the individual surface electrodes respectively are consequently separated or away from one another, thereby eliminating the fear that solder and/or paste flow and enter into areas which are deformable areas in the actuator unit. In addition, since at least in the three land portions on the signal-line drawn side, a certain land portion which corresponds to a certain individual surface electrode on the signal-line drawn side and land portions which are at both ends of the certain land portion and which correspond to individual surface electrodes adjacent to the certain individual electrode are located at positions shifted from one another in the longitudinal direction of the pressure chambers, it is possible to make the spacing distance between the land portions to be wider than in a case in which the land portions are aligned in a horizontal row. Accordingly, the signal lines, of the flexible cable, formed as a conductive pattern, can be wired (drawn) in a non-narrow manner between the connection terminals electrically connected to the land portions.

In the ink-jet printer of the present invention, the head may include only one piece of the flexible cable. In this case, since the head of the ink-jet printer does not use a plurality of flexible cables, it is possible to enhance the reliability of the electrical connection and mechanical connection between the land portions and the connection terminals.

BRIEF DESCRIPTION OF THE DRAWINGS

FIGS. 7A and 7B show a first embodiment of the present invention, wherein FIG. 7A shows a relationship between the individual surface electrodes and pressure chambers, and FIG. 7B shows an arrangement of the connection terminals of the signal lines.

FIGS. 10A and 10B show a second modified embodiment according to the present invention, wherein FIG. 10A shows a relationship between the individual surface electrodes and the pressure chambers, and FIG. 10B shows an arrangement of the connection terminals of the signal lines.

DESCRIPTION OF THE PREFERRED EMBODIMENTS

In the following, embodiments of the present invention will be explained with reference to the drawings.

Figure 1A:
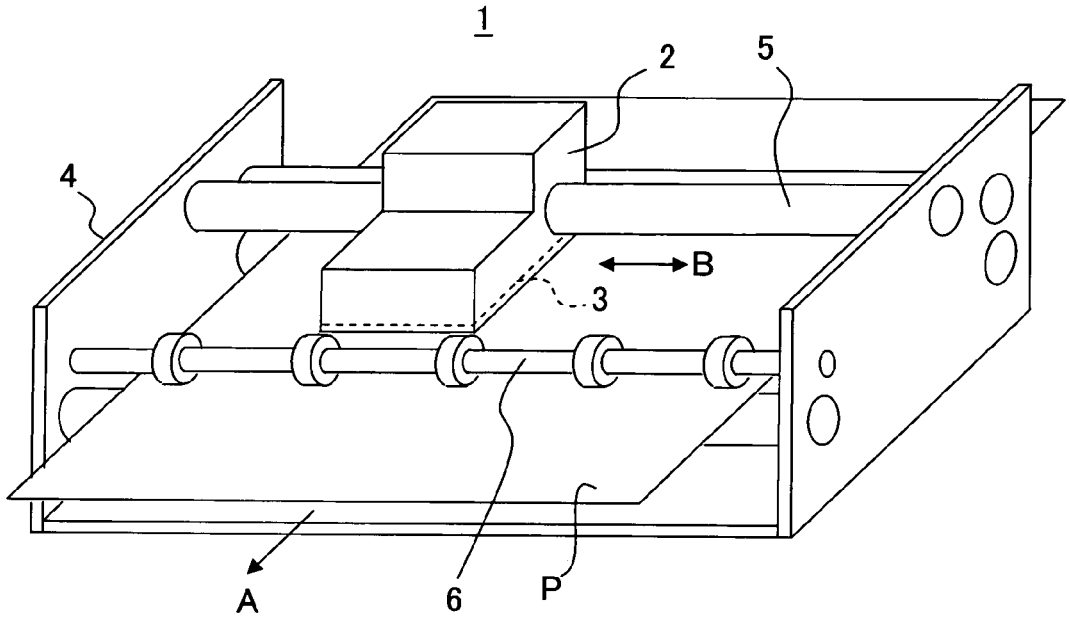
FIG. 1A is a schematic structural view of an ink-jet printer according to the present invention.
Figure 1B:
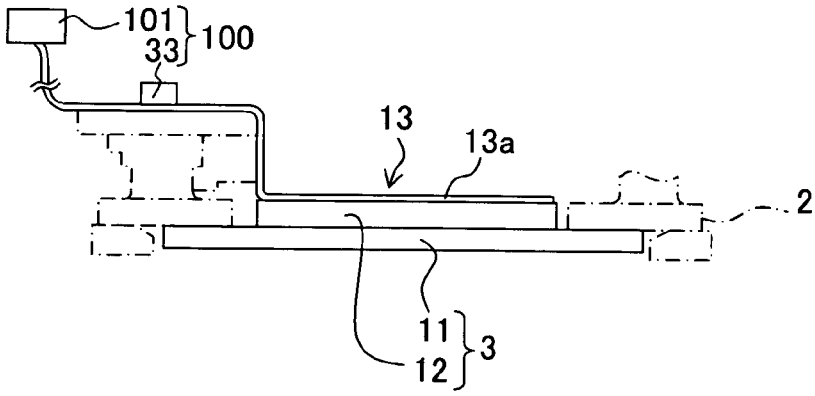
FIG. 1B is a diagram showing a relationship among a cavity unit, an actuator unit and a flexible flat cable according to the present invention.

FIG. 1A is a schematic structural view of an ink-jet printer 1 according to the present invention, and FIG. 1B is a diagram showing a relationship among a cavity unit, an actuator unit and a flexible flat cable of the ink-jet printer 1 according to the present invention.

The ink-jet printer 1 according to the present invention includes, as shown in FIG. 1A, a carriage 2 to which an ink cartridge (not shown) is provided, and a head 3 for ink-jet printer (hereinafter referred simply to as "head") which performs recording on a recording paper P (recording medium) and which is provided to a lower surface of the carriage 2. The carriage 2 is supported by a guide plate (not shown) and a carriage shaft 5 arranged in a printer frame 4, and is reciprocabale in a direction B orthogonal to a transporting direction A in which the recording paper P is feed or transported.

The recording paper P, transported from a paper feeding section (not shown) in the direction A, is introduced between a platen roller (not shown) and the head 3 to be subjected to a recording of a predetermined image or the like with an ink discharged from the head 3 onto the recording paper P, and then the recording paper P is discharged by discharge rollers 6.

Figure 2:
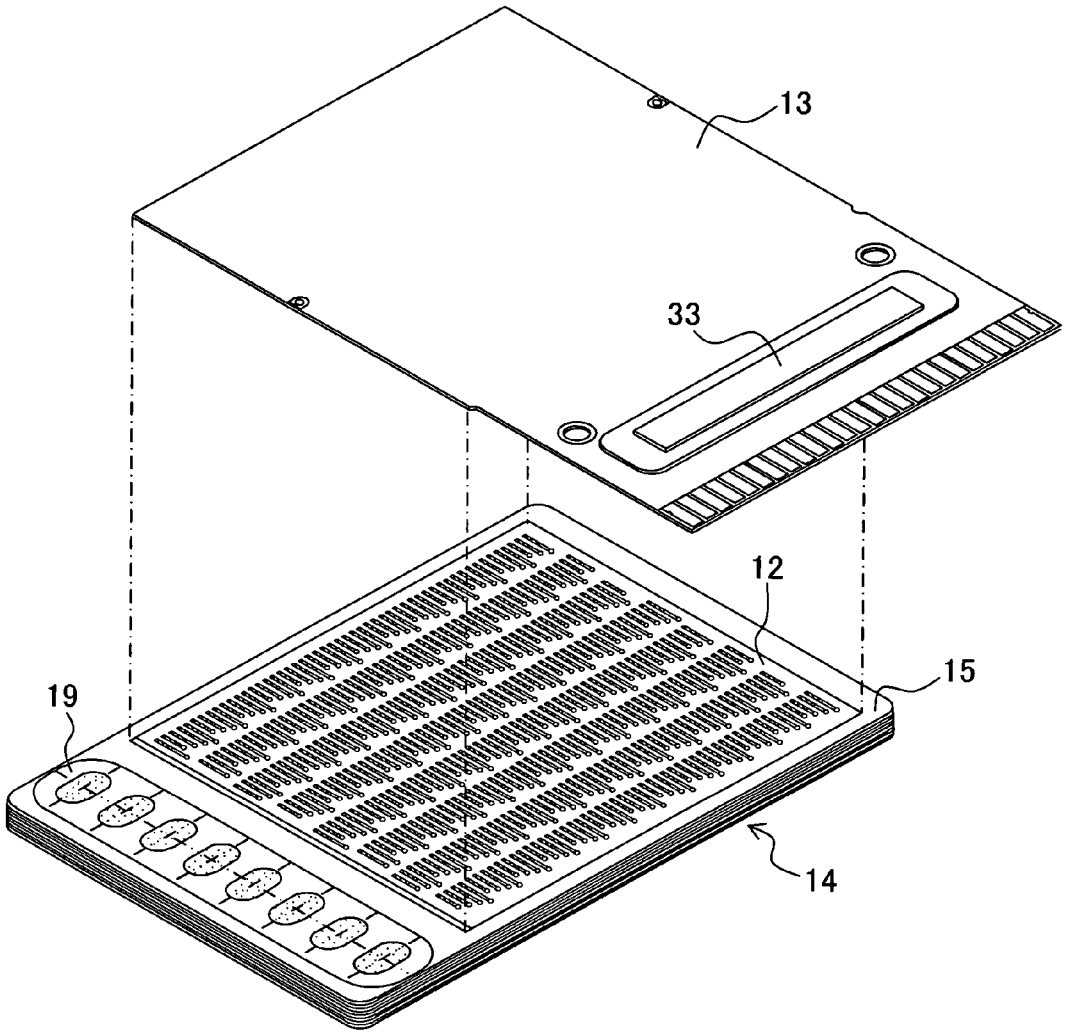
FIG. 2 is a drawing showing a relationship among the cavity unit, the actuator unit and the flexible flat cable.

Further, as shown in FIGS. 1B and 2, the head 3 includes a cavity unit 11, an actuator unit 12 disposed on a lower side of the head in this order. A flexible cable 13 which includes signal lines and supplies drive signal is provided on the upper surface of the actuator unit 12. One end of the flexible cable 13 is connected to the actuator unit 12, and the other end of the flexible cable 13 is connected to a drive control unit 100. The drive control unit 100 includes a drive control section 101 which sends a signal for controlling the drive of the carriage 2, and a driver IC 33 which feeds or transmits drive signal (drive voltage) to individual surface electrodes of the actuator unit. The individual surface electrodes are formed corresponding to pressure chambers, respectively, and will be described later on.

Figure 3A:
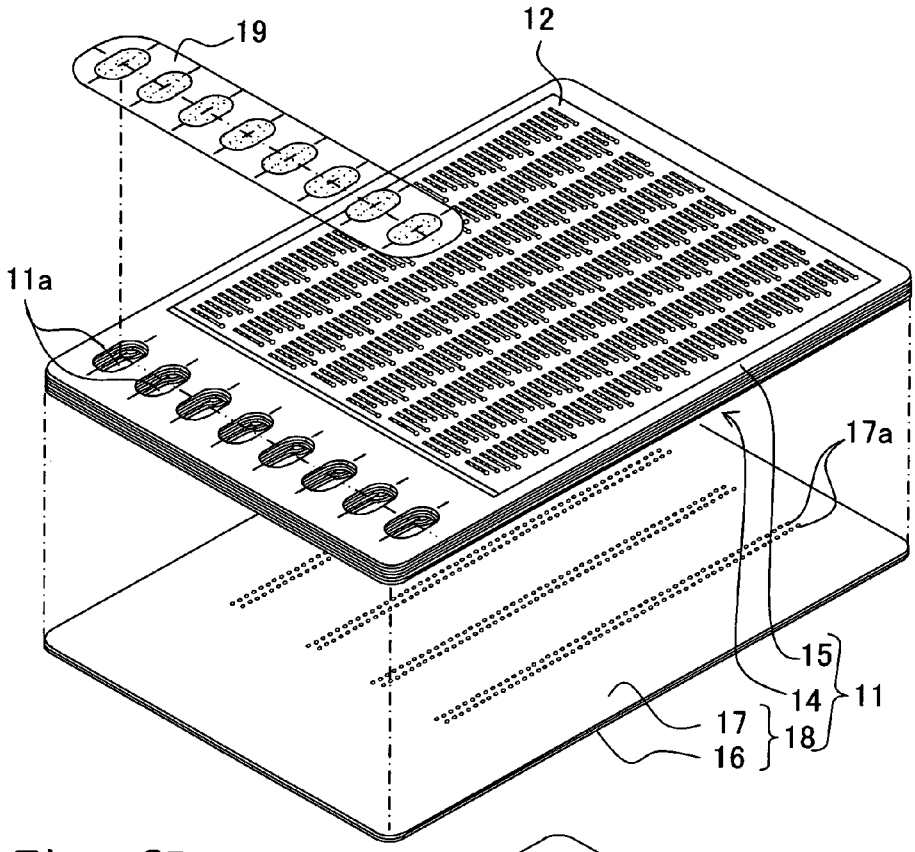
FIG. 3A is a diagram in which the cavity unit is exploded into a stack, and a nozzle plate and a spacer plate adhered to each other.
Figure 3B:
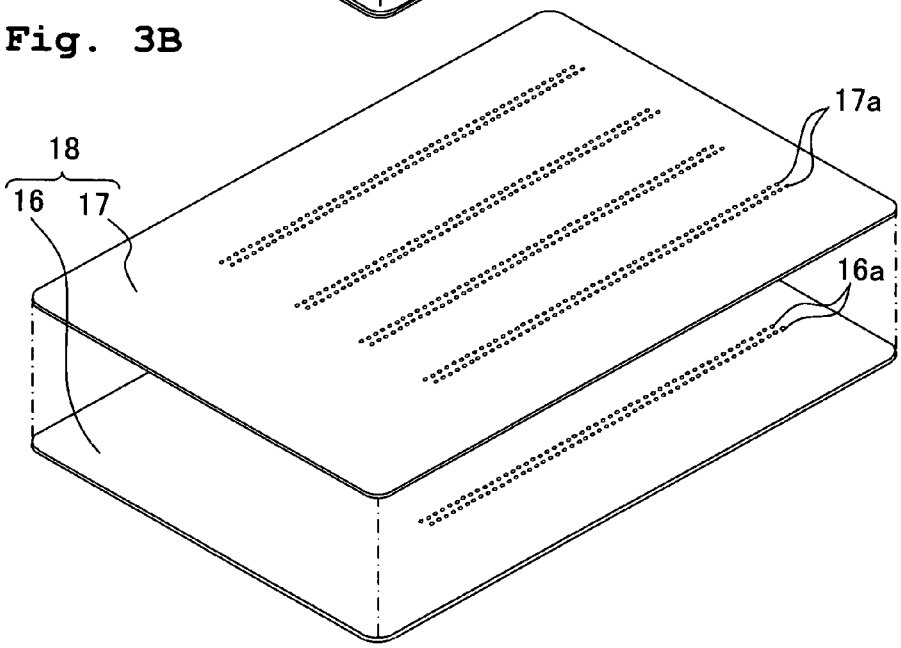
FIG. 3B is a diagram showing the nozzle plate and the spacer plate.

As shown in FIGS. 2, 3A and 3B, the cavity unit 11 includes a stack 14 formed of a plurality of plates. On the upper side of the stack 14, a top plate 15 which will be explained later is provided, and a plate assembly 18 is adhered to the lower side of the cavity unit 11 in an integrated manner. The plate assembly 18 is formed by joining (adhering) a nozzle plate 16 and a spacer plate 17 together.

As shown in FIGS. 3A and 3B, the actuator unit 12 is provided on the upper side of the top plate 15. Further, the cavity unit 11 has openings 11*a* to each of which a filter 19 for capturing dust, dirt or the like existing in the ink is provided. The nozzle plate 16 is a plate which is made of synthetic resin (for example, polyimide) and has nozzles 16a formed therein, and each of the nozzles 16*a* corresponds to one of the pressure chambers 14Aa of a cavity plate 14A. The cavity plate 14A constructs the stack 14 and will be described later. Further, the spacer plate 17 is a metallic plate in which through holes 17*a*, corresponding to the nozzles 16*a* respectively, are formed. Alternatively, the nozzle plate 16 may be a metallic plate.

Figure 4:
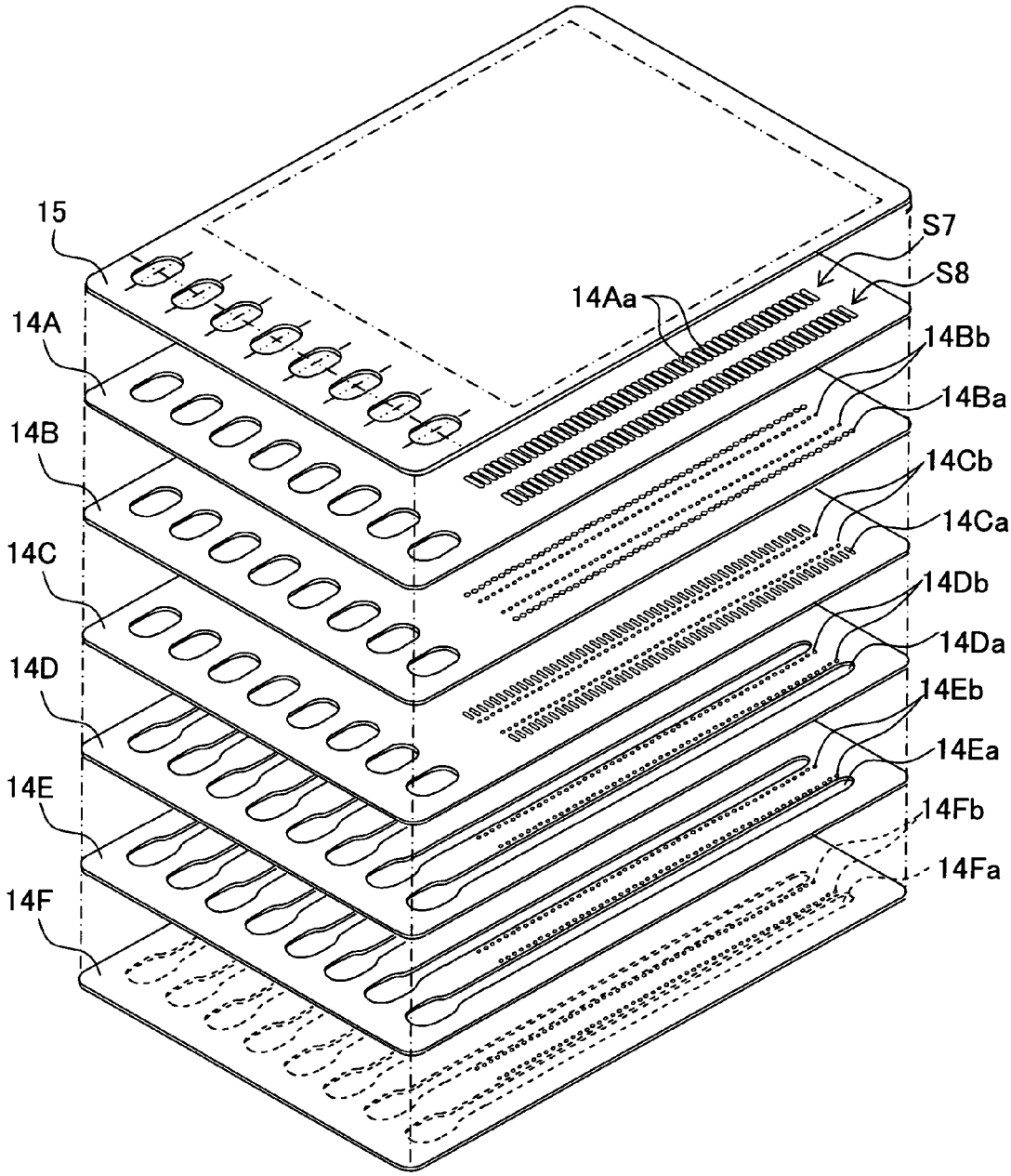
FIG. 4 is a diagram showing the stack which construct the cavity unit, exploding the stack into plates each constructing the stack and showing the stack together with a top plate.
Figure 5:
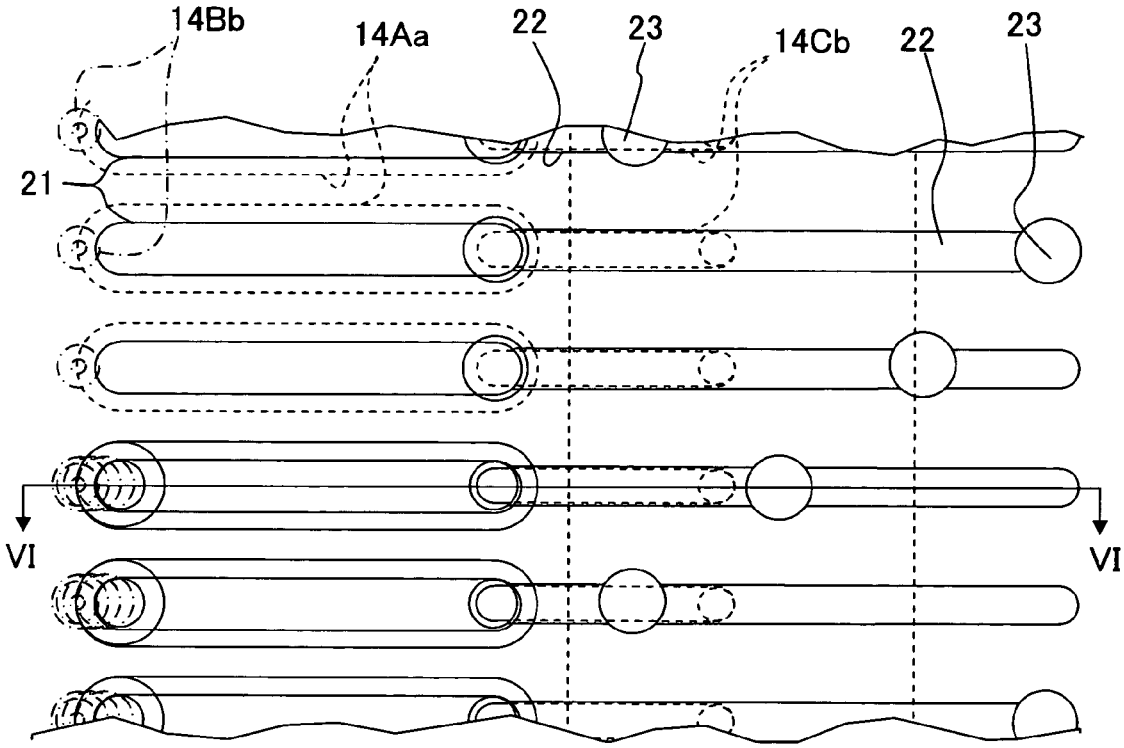
FIG. 5 is a diagram showing an upper surface of the actuator unit.
Figure 6:
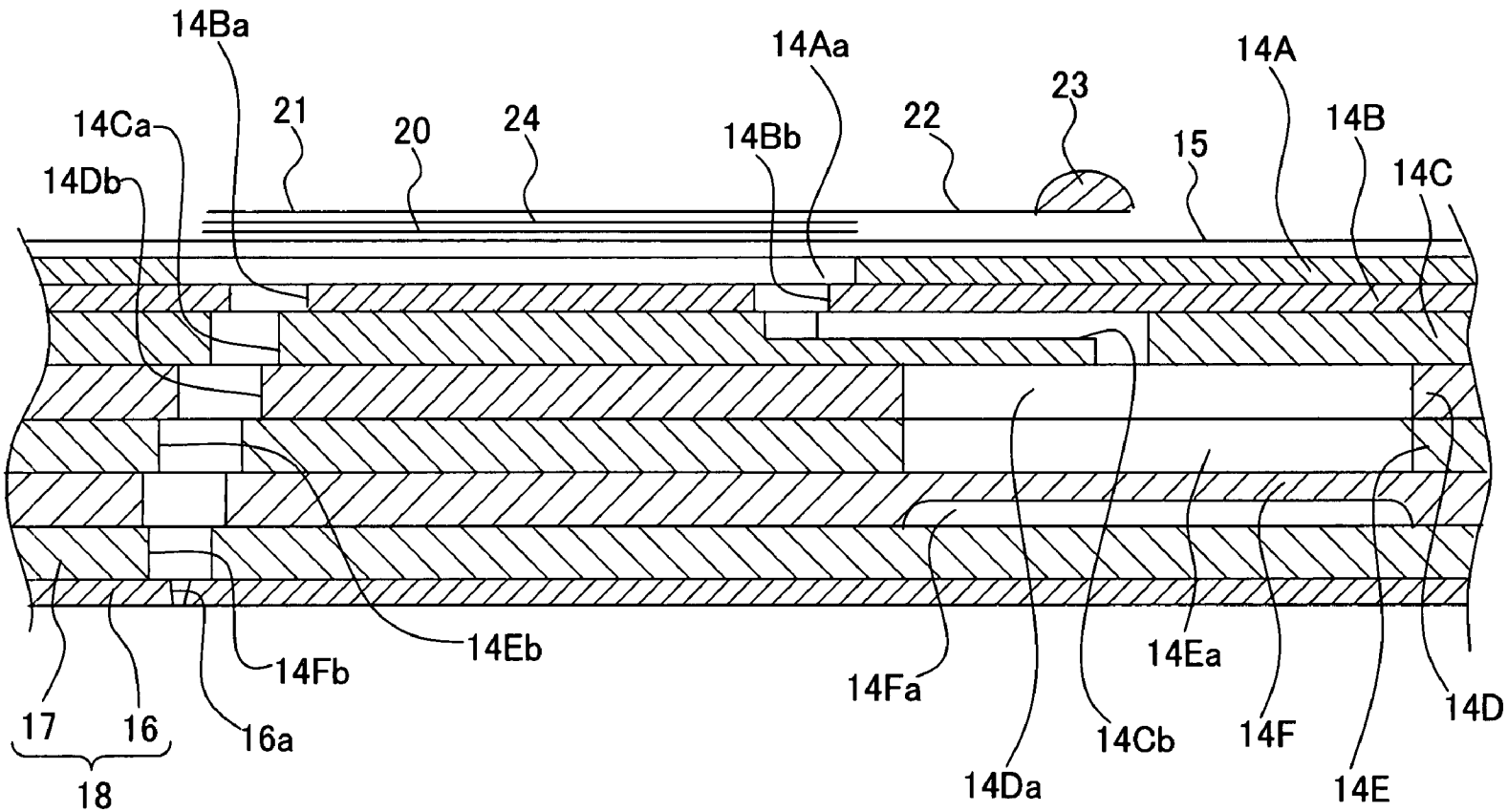
FIG. 6 is a cross-sectional view taken along a line VI-VI in FIG. 5.

As shown in FIGS. 4 and 6, the stack 14 is formed by overlaying (stacking) the cavity plate 14A, a base plate 14B, an aperture plate 14C, two manifold plates 14D, 14E, and a damper plate 14F from the upper side in this order, and by subjecting the plates to the metal diffusion bonding to bond the plate together. These six plates 14A to 14F are positioned with respect to one another and stacked on top of one another so as to form individual ink channels each communicating with one of the nozzles 16*a*. Here, in the metallic cavity plate 14A, a large number of through holes aligned in rows in a regular manner is formed, and the pressure chambers 14Aa are formed by these through holes respectively. In the metallic base plate 14B, through holes 14Ba and through holes 14Bb are formed. The through holes 14Ba communicate manifolds 14Da, 14Ea (common ink chambers) with the pressure chambers 14Aa, and the through holes 14Bb communicate the pressure chambers 14Aa with the nozzles 16*a* respectively. Also in the metallic aperture plate 14C, through holes 14Ca and through holes 14Cb are formed. The through holes 14Cb communicate manifolds 14Da, 14Ea with the pressure chambers 14Aa, and the through holes 14Ca communicate the pressure chambers 14Aa with the nozzles 16*a* respectively. In the metallic manifold plate 14D, the manifold 14Da (common ink chamber) and through holes 14Db are formed and in the metallic manifold plate 14E, the manifold 14Ea (common ink chamber) and through holes 14Eb are formed. The through holes 14Db communicate each of the pressure chambers 14Aa to one of the nozzles 16, and the through holes 14Eb communicate each of the pressure chambers 14Aa to one of the nozzles 16a. In the metallic damper plate 14F, damper chambers 14Fa and through holes 14Fb are formed. The through holes 14Fb communicate the pressure chambers 14Aa with the nozzles 16*a* respectively.

As shown in FIG. 6, the actuator unit 12 includes inner common electrodes 20 formed on the top plate 15 to correspond to the pressure chambers 14Aa, respectively; piezoelectric sheets 24 formed on the inner common electrodes 20, respectively; surface electrodes 21 (individual surface electrodes) each of which formed on a surface of one of the piezoelectric sheets 24; electrode-drawing portions 22 which are drawn in the longitudinal direction of the pressure chambers 14Aa, and are electrically conducted to the individual surface electrodes 21, respectively; land portions 23 which are circular shaped, which are conducted to the electrode-drawing portions 22, respectively, and to each of which a connection terminal 32 of the flexible cable is connected. The connection terminal 32 of the flexible cable will be described later.

The piezoelectric sheets 24 are formed of a ceramics material which is a lead zirconate titanate (PZT)-based material and is ferroelectric. Each of the piezoelectric sheets 24 is polarized in a thickness direction thereof. The surface electrodes 21 are made of a metallic material such as an Ag—Pd based material, and are connected to the driver IC 33 (see FIG. 2) via signal lines 31, of the flexible cable 13, to which the drive signal is supplied. On the other hand, the inner common electrodes 20 are kept at a ground potential all the time. Accordingly, by making an electric potential of the surface electrodes 21 to be higher (or lower) than the ground potential, an electric field is applied to the piezoelectric sheets 24 in a polarization direction in which the piezoelectric sheets 24 are polarized. The piezoelectric sheets 24, to which the electric field is applied, are contracted as active layers in a direction orthogonal to the polarization direction by the piezoelectric horizontal effect. On the other hand, the top plate 15 does not contract by itself (voluntarily) because the top plate 15 is not affected by the electric field. Consequently, there is caused a difference in the distortion (warpage), in the direction orthogonal to the polarization direction, between the top plate 15 as a lower-side layer and the piezoelectric sheets 24. Since the top plate 15 is fixed to the cavity plate 14A, the piezoelectric sheets 24 and the top plate 15 are deformed to project toward the pressure chambers 14Aa (unimorphic deformation). As a result, the volume of the pressure chambers 14Aa is decreased, and thus the pressure in the pressure chambers 14Aa is increased, thereby discharging the ink from the nozzles 16. Afterwards, when the electric potential of the surface electrodes 21 are returned to be same as that of the inner common electrodes 20, the piezoelectric sheets 24 and the top plate 15 are returned to their original forms respectively, which in turn makes the volume of the pressure chambers 14Aa to their original volume to thus decrease the increased pressure in the pressure chambers 14Aa, thereby making the ink flow into the pressure chambers 14Aa from the manifold 14Da, 14Ea. In a similar manner as described above, the operation for ink discharge can be repeated.

As described above, in this embodiment, the top plate 15 is provided, as a vibration plate, in the upper portion of the cavity unit 11. Accordingly, it is possible to realize excellent discharge efficiency with the unimorphic deformation.

As described above, the cavity unit 11 includes the nozzles 16*a;* the pressure chambers 14Aa communicating with the nozzles 16*a*, respectively; and the manifolds 14Da, 14Ea which temporarily store the ink to be supplied to the pressure chambers 14Aa. On the other hand, the actuator unit 12 includes the individual surface electrodes 21 corresponding to the pressure chambers 14Aa respectively, and supplies the drive signal to the individual surface electrodes 21 to change the volume of the pressure chambers 14Aa, thereby discharging the ink from the nozzles 16.

Figure 7A:
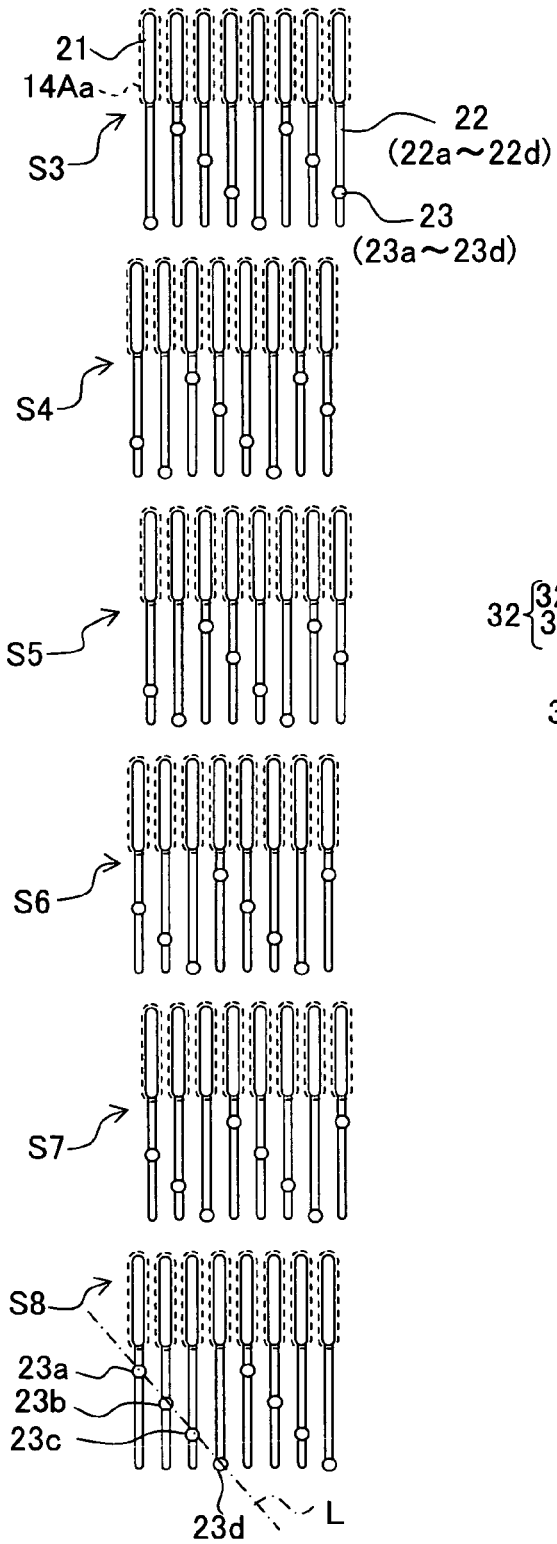
Figure 7B:
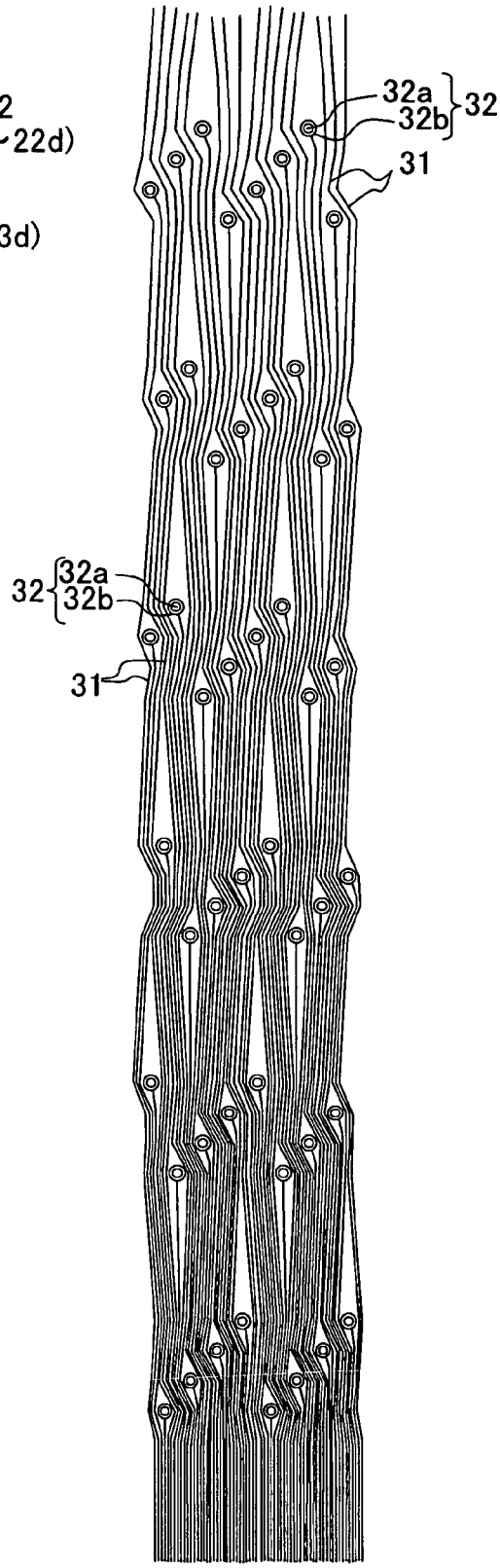
Figure 8:
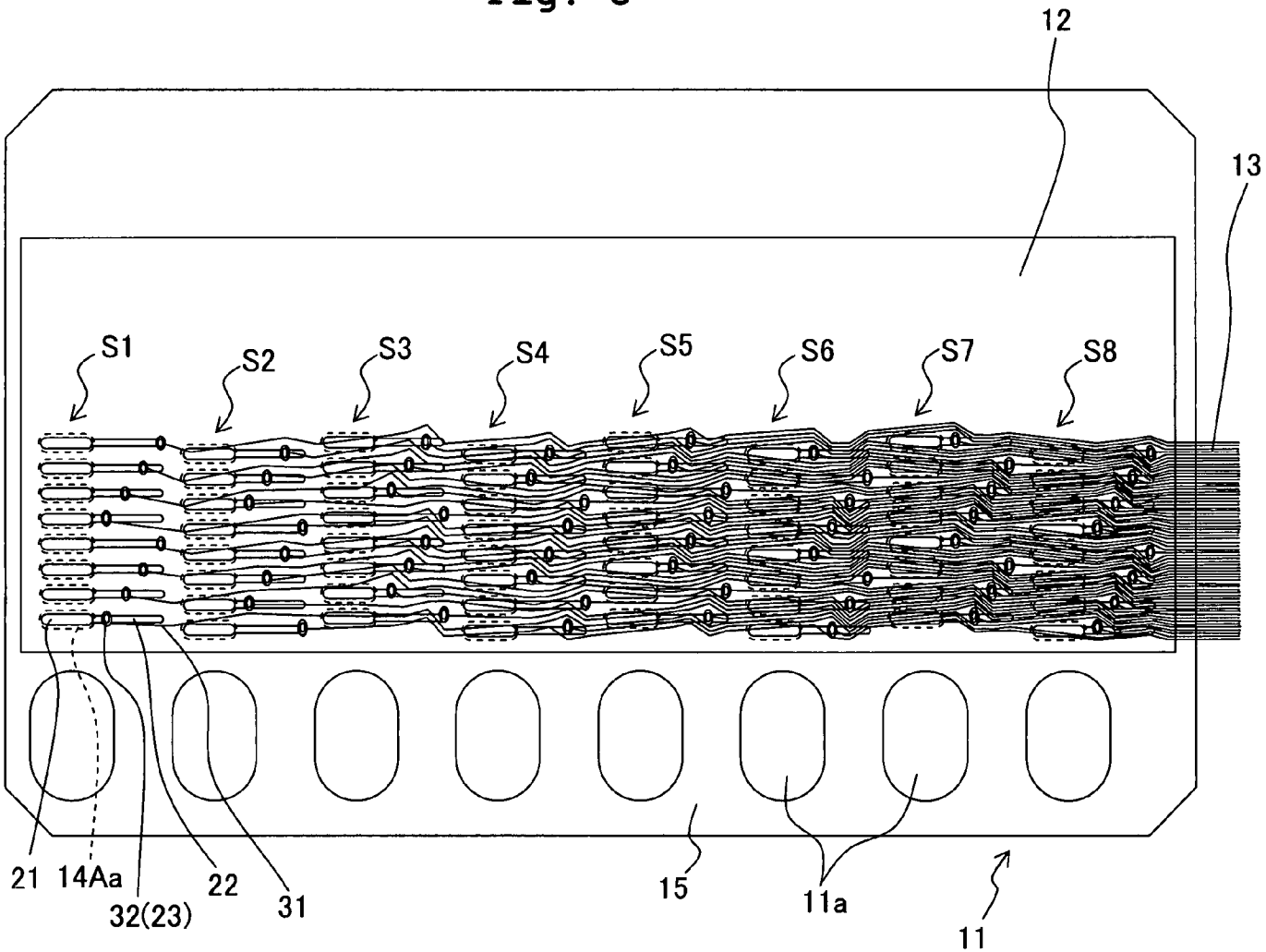
FIG. 8 is a plan view showing a state in which the connection terminals are connected to the individual surface electrodes.

Next, an explanation will be further given regarding the connection of the signal lines of the flexible cable 13 (COP) and the individual surface electrodes 21, with reference to FIGS. 7 and 8.

As shown in FIG. 7A, the individual surface electrodes 21 having a shape of elongated ellipse, the electrode-drawing portions 22 extending from the individual surface electrodes 21 respectively and in parallel with one another, and the land portions 23 formed on the electrode-drawing portions 22 respectively, are arranged in a regular manner on the upper surface of the actuator unit 12 so as to correspond to the pressure chambers 14Aa, respectively. Each of the individual surface electrodes 21 is formed at a position corresponding to one of the pressure chambers 14Aa, and is included within an area overlapping in a plan view with one of the pressure chambers 14Aa. Further, each of the electrode-drawing portions 22 is located at a location above or over the manifolds 14Da and 14Ea.

Furthermore, each of the electrode-drawing portions 22 has a width narrower than that of the individual surface electrode 21. Moreover, in order to make the electrostatic capacitance generated due to the electrode-drawing portions 22 to be same among all of the electrode-drawing portions 22, a length of the electrode-drawing portions 22 in the longitudinal direction of the pressure chamber 14Aa is made to be same among the electrode-drawing portions 22. The area dimension (area) of the individual surface electrodes 21 is made to be same among the individual surface electrodes 21 in a plan view, the area of the land portions 23 are made to be same among the land portions 23 in a plan view, and the electrode-drawing portions 22 are made to have a length which is same among all of the electrode-drawing portions 22. Accordingly, the electrostatic capacitance is equal among electrodes as a whole, each of which including one of the individual electrodes 21, one of the electrode-drawing portions 22 and one of the land portions 23, thereby simplifying the waveform control.

The pressure chambers 14Aa are arranged such that the pressure chambers 14Aa forms a plurality of pressure-chamber rows S1 to S8 (see FIG. 8) linearly aligned in a direction different from the longitudinal direction of the pressure chambers 14Aa (in this embodiment, a direction orthogonal to the longitudinal direction of the pressure chambers 14Aa). Accordingly, the individual surface electrodes 21, provided to correspond to the pressure chambers 14Aa, respectively, are also arranged in a plurality of rows aligned linearly in the direction different from the longitudinal direction of the pressure chambers 14Aa. The pressure-chamber rows S1 to S8 are used for color inks of different colors every two rows in the rows, respectively, and include rows of color-specific or color-designated pressure chambers in which the rows S1 and S2 are for magenta ink, the rows S3 and S4 are for cyan ink, the rows S5 and S6 are for yellow ink, and the rows S7 and S8 are for black ink.

The land portions 23 are arranged such that a certain land portion 23, among the land portions 23 and conducted to a certain individual surface electrode 21 included in the individual electrodes 21 and corresponding to a certain pressure chamber 14Aa belonging to one of the pressure-chamber rows S1 to S8, is formed on a certain electrode-drawing portion 22 among the electrode-drawing portions 22 and corresponds to the certain pressure chamber 14Aa to which the certain individual surface electrode 21 also corresponds.

The land portions 23A are arranged such that a certain land portion 23, among the land portions 23 and corresponding to a certain pressure chamber 14Aa among the pressure chambers 14Aa and belonging to one of the pressure-chamber rows S1 to S8, is arranged at a position shifted in the longitudinal direction with respect to another land portion 23 which corresponds to another pressure chamber 14Aa which is adjacent to the certain pressure chamber 14Aa and which belongs to the same pressure-chamber row to which the certain pressure chamber 14Aa also belongs.

Further, the land portions 23 may be arranged such that a certain land portion 23 among the land portions 23 is arranged at a space between an electrode-drawing portion 22 among the electrode-drawing portions 22 and conducted to the certain land portion 23 and another electrode-drawing portion 22 conducted to another land portion 23 adjacent to the certain land portion 23.

In any of the above cases, a gap (space) is provided in an area between a land portion 23 and an electrode-drawing portion 22 which is adjacent to the land portion 23, so as to avoid the electrical contact between the land portion 23 and the adjacent electrode-drawing portion 22.

As shown in FIG. 7B, the signal lines 31 which supply the drive signal are formed as a conductive pattern on a flexible and insulative substrate (not shown) which is formed in a band-like shape extending in the longitudinal direction of the pressure chambers 14Aa. The connection terminal 32 of each of the signal lines 31 is formed as a copper-foil portion 32*b* formed with a through hole 32*a* through a center of the copper-foil portion 32*b*. The signal lines 31 which supply the drive signal are drawn in a same direction, and a drawing direction in which the signal lines are drawn is parallel to the longitudinal direction of the pressure chambers 14Aa.

The connection terminal 32 of each of the signal lines 31 is arranged in the flexible and insulative substrate to correspond to one of the land portions 23 conducted to the individual surface electrodes 21 respectively, thereby forming the flexible cable 13 (COP). By filling solder into the through hole 32*a* formed in the connection terminal 32 of each of the signal lines 31, the connection terminal 32 is electrically connected to each of the individual surface electrodes 21 via one of the land portions 23.

The land portions 23 are arranged such that a certain land portion 23 is arranged to shift in the longitudinal direction of the pressure chamber 14Aa from another land portion 23 adjacent to the certain land portion 23. In other words, in this embodiment, the land portions 23 are divided into groups (land portion groups) by every four pieces of the land portion 23, the groups being adjacent to one another in each of the pressure-chamber rows S1 to S8, and a same arrangement pattern is repeated for each of the groups.

Specifically, as shown in FIG. 7A, a plurality of land portions 23*a*, 23*b*, 23*c* and 23*d* forming each of the groups is arranged along a straight line L inclined with respect to the longitudinal direction of the pressure chamber 14Aa. Accordingly, in each of the groups, the land portions 23*a* to 23*d* are arranged at an equal spacing distance in the longitudinal direction of the pressure chambers 14Aa, and the spacing distance is wider than in a case in which the land portions 23*a* to 23*d* are aligned horizontally to one another. By such an arrangement, as shown in FIGS. 7B and 8, in the flexible cable 13, the connection terminals 32 are arranged corresponding to the land portions 23 (23*a* to 23*d*). Accordingly, the spacing distance between the connection terminals 32 also becomes wider than in a case in which the connection terminals 32 are arranged horizontally to one another. Thus, it is possible to perform wiring for the conductive pattern of the signal lines between the connection terminals in a non-narrow manner (with enough space).

The present invention is not intended to be limited to the embodiment as described above, and is applicable to the following modified embodiments.

First Modified Embodiment

Figure 9:
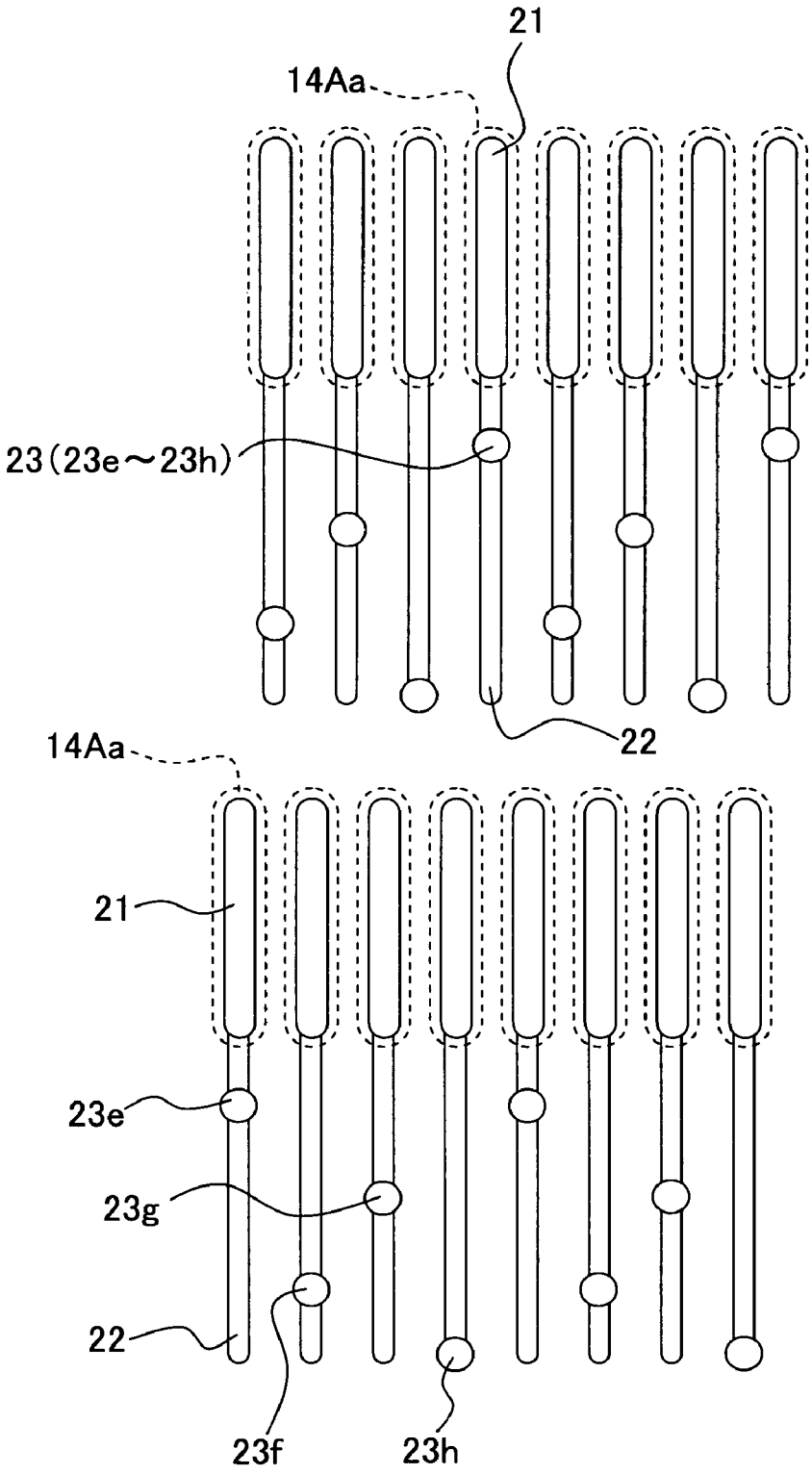
FIG. 9 is a diagram showing a relationship between the individual surface electrodes and the pressure chambers in a first modified embodiment.

In the above-described embodiment, the plurality of land portions constructing each of the groups are arranged on the straight line L inclined with respect to the longitudinal direction of the pressure chambers 14Aa. However, the land portions may be arranged, for example, as shown in FIG. 9.

Figure 10A:
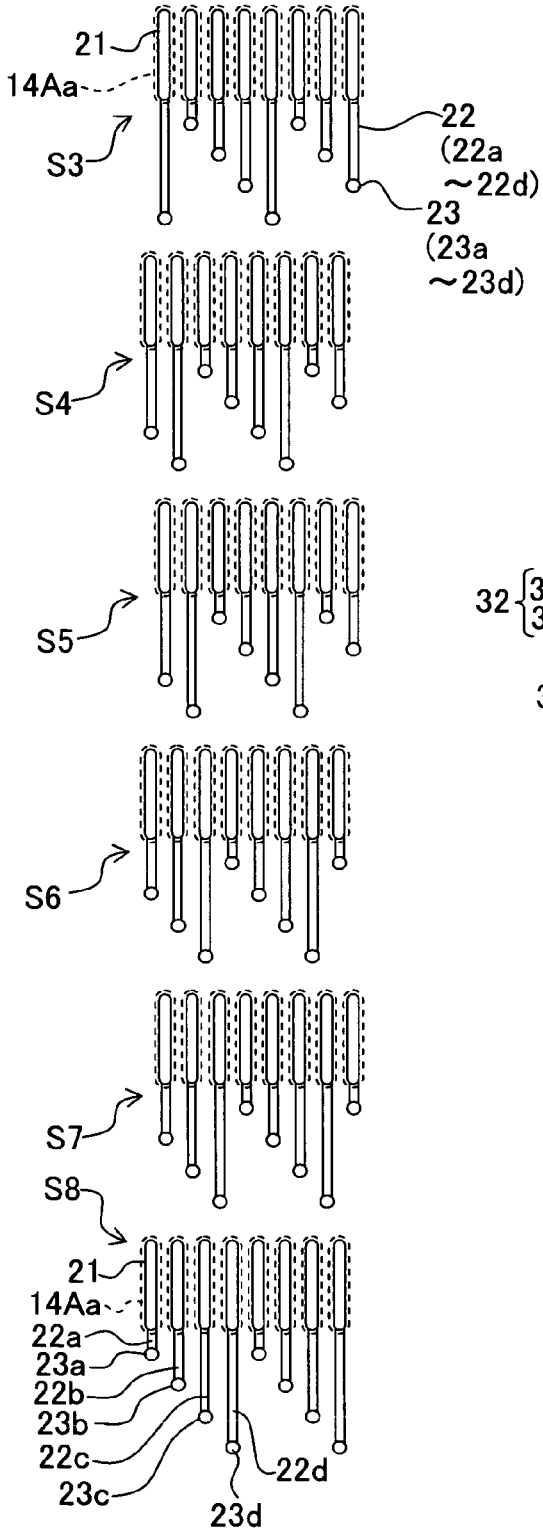
Figure 10B:
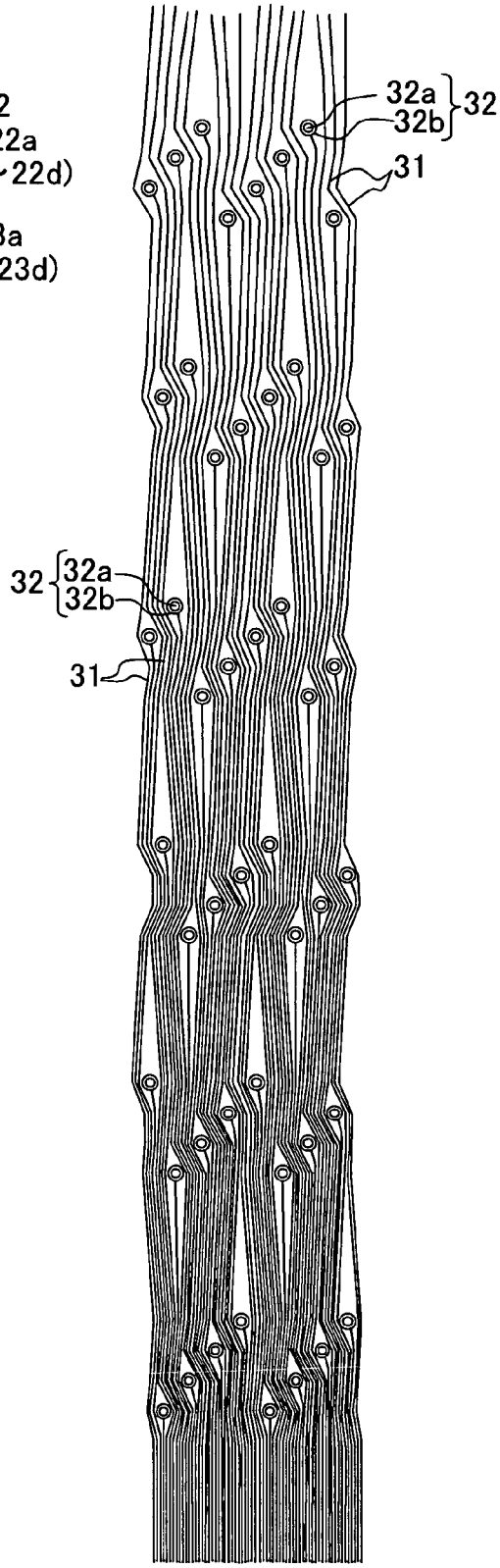
Figure 11:
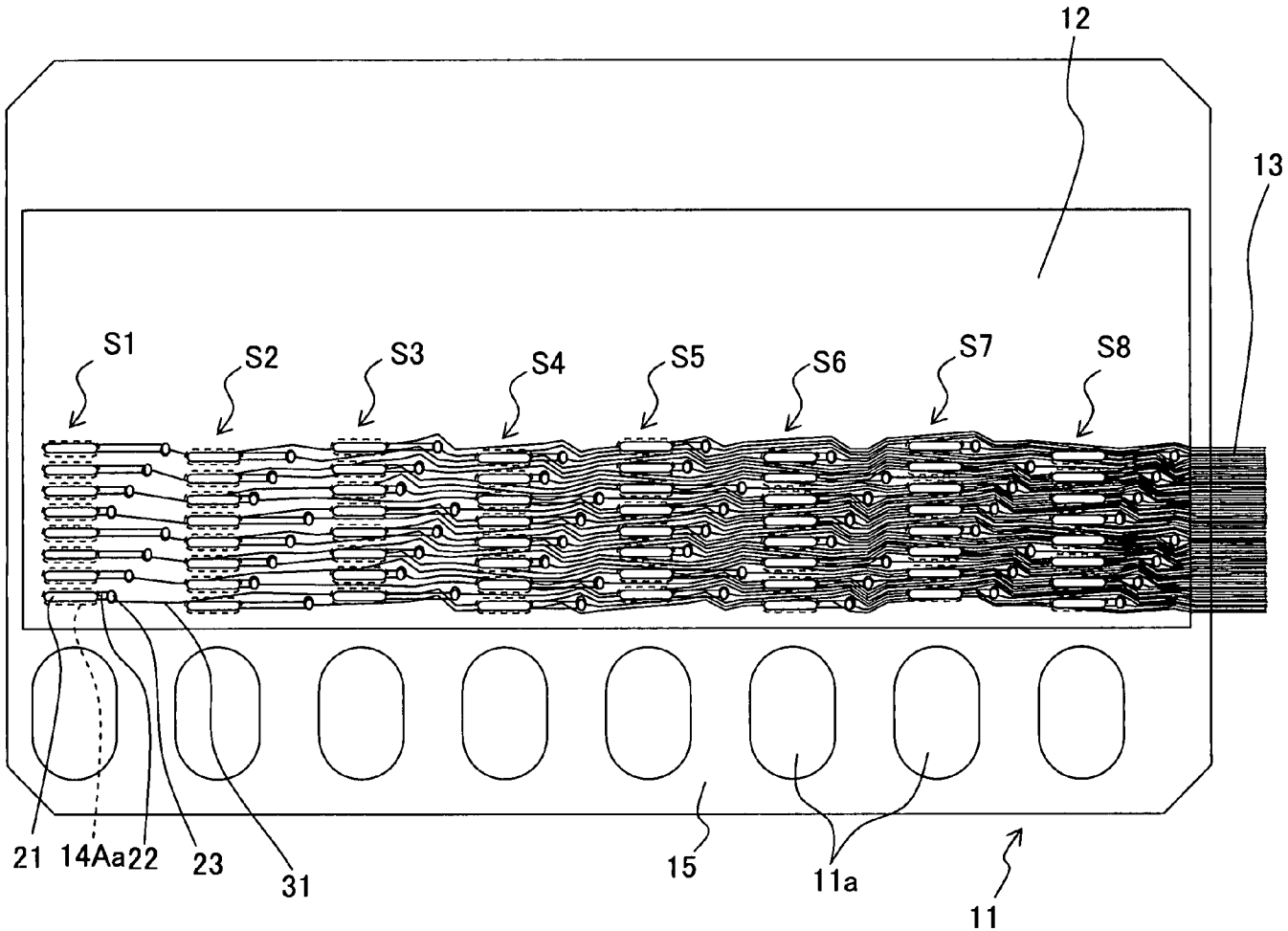
FIG. 11 is a plan view showing a state in which the connection terminals of the signal lines are connected to the individual surface electrodes.

In this case, a plurality of land portions 23*e*, 23*f*, 23*g* and 23*h* constructing each of the groups are arranged one by one at a uniform spacing distance in the longitudinal direction of the pressure chambers 14Aa. Further, in each of the groups, the spacing distance is widest between the land portions 23*e* and 23*h* disposed at both ends, respectively, of each of the groups, and the remaining land portions 23*f* and 23*g* are not arranged on a straight line connecting the two land portions 23*e* and 23*h*. In this case also, in the flexible cable 13, the spacing distance between the connection terminals 32 arranged corresponding to the land portions 23 (23*e* to 23*h*) are wider than in a case in which the connection terminals 32 are arranged in horizontally to one another. Accordingly, as shown in FIGS. 10B and 11, the conductive pattern of the signal lines 31 formed between the connection terminals 32 can be wired or drawn in a non-tight manner. Further, upon electrically connecting the connection terminals 32 of the flexible cable 13 and the land portions 23 of the actuator unit 12 with solder or the like, it is necessary to press the flexible cable 13 against the actuator unit 12. At this time, it is possible to press the flexible cable 13 against the actuator unit 12 in a more uniform and balanced manner than in a case in which the land portions are linearly arranged (arranged along a straight line).

Second Modified Embodiment

In the embodiment as described above, the electrode-drawing portions 22 are formed such that the electrode-drawing portions 22 have a same length in the longitudinal direction of the pressure chambers 14Aa and that the electrostatic capacitance is same among the electrode-drawing portions 22. However, the present invention is not intended to be limited to the way the electro-drawing portions are formed in the embodiment. As shown in FIGS. 10A, 10B and 11, lengths of electrode-drawing portions 22*a* to 22*d* may be changed depending on the position of land portions 23*a* to 23*d* to which the electrode-drawing portions 22*a* to 22*d* are conducted, respectively. In this case also, by controlling the waveform to be supplied to each of the individual surface electrodes appropriately, the same effect can be obtained as with the embodiment.

Third Modified Embodiment

In the above-described embodiment, each of the group of the individual surface electrodes includes four individual surface electrodes. However, the number of the individual electrodes included in each of the groups is not limited to four, and the number of the individual surface electrodes forming each of the groups may be three, five or not less than five.

Fourth Modified Embodiment

Although in the above-described embodiment, the pressure chambers 14Aa include color-designated pressure chambers to which inks of different colors (magenta, cyan, yellow and black) are supplied respectively, there is no limitation to the color of the ink supplied to pressure chambers 14Aa corresponding to individual surface electrodes 21 on the signal-line drawn side at which the signal lines 31 are drawn. In the following case, however, it is desired that pressure chambers to which the black ink is supplied are arranged on the signal-line drawn side.

Since a large ink discharge amount is generally required for the black ink, the length of pressure chambers 14Aa and the length of manifolds 14Da, 14Ea for the black ink are greater than those for other colors other than black for purpose of the stable ink discharge. In such a case, the length of the electrode-drawing portions 23 positioned above or over the manifolds 14Da, 14Ea for the black ink is greater than the length of electrode-drawing portions 23 positioned above or over the manifolds 14Da, 14Ea for the colors other than black. Accordingly, it is possible to make the spacing distance in the longitudinal direction of the pressure chambers 14Aa between the land portions greater than in a case in which the pressure chambers and the manifolds for the colors other than black are arranged at the signal-line drawn side. Thus, it is possible to secure the wiring pitch of the conductive pattern of the signal lines 31 in a non-tight manner.

Fifth Modified Embodiment

Although in the embodiment, the individual surface electrodes in all of the pressure-chamber rows are arranged such that a certain individual surface electrode is arranged to shift, in the longitudinal direction of the pressure chamber, from another individual surface electrode adjacent to the certain individual surface electrode, the present invention is not limited to this arrangement. A sufficient effect can be obtained by perform an arrangement, at least in the pressure-chamber row on the signal-line drawn side, such that the land portions conducted to the individual surface electrodes are arranged to shift from one another in the longitudinal direction of the pressure chambers. The wiring pitch of the signal lines is narrowest in the signal-line drawn side. Therefore, the effect can be obtained when at least the land portions, conducted with the individual surface electrodes on the signal-line drawn side, are arranged to shift from one another in the longitudinal direction of the pressure chambers.

Sixth Modified Embodiment

Although in the above-described embodiment, the land portions are arranged at a constant spacing distance, the present invention is not limited thereto. Since the wiring pitch of the signal lines becomes the tightest or narrowest on the signal-line drawn side, the following arrangement can also be adopted in which a spacing distance between land portions belonging to a certain group, which is located nearer to the signal-drawn side, is wider than a spacing distance between land portions belonging to another group which is located farther from the signal-line drawn side than the certain group. Alternatively, an arrangement may be adopted in which, in a group, the spacing distance between the land portions only on the signal-line drawn side may be widest than the remaining land portions belonging to the group.

Seventh Modified Embodiment

Although in the above-described embodiment, the actuator unit has the inner common electrodes each formed over or above one of the pressure chambers, the piezoelectric sheets each formed on one of the inner common electrodes, and the individual surface electrodes each formed on one of the piezoelectric sheets, the present invention is not intended to be limited thereto. The present invention is applicable also to an actuator unit provided with sheet materials each of which includes a piezoelectric ceramics and which are stacked in a plurality of layers and extending over or across a plurality of pressure chambers so as to cover the pressure chambers; a plurality of individual electrodes and a plurality of common electrodes which correspond to one of the pressure chambers, the individual electrodes and the common electrodes being provided between the stacked sheet materials and arranged alternately between the sheet materials in a direction in which the sheet materials are stacked, wherein one of the common electrodes is arranged at a position closest to a cavity unit.

What is claimed is:

1. A head for ink-jet printer which discharge an ink, the head comprising:

a cavity unit including a plurality of nozzles, a plurality of elongated pressure chambers communicating with the nozzles, respectively, and a manifold storing the ink to be supplied to the pressure chambers;

an actuator unit having individual surface electrodes which are formed corresponding to the pressure chambers, respectively, electrode-drawing portions which are drawn in a longitudinal direction of the pressure chambers, respectively and are conducted to the individual surface electrodes, respectively, and land portions which are conducted to the electrode-drawing portions, respectively, the actuator changing volume of the pressure chambers respectively, when driving signal is supplied to the individual surface electrodes, so as to discharge the ink from the nozzles; and a flexible cable arranged to overlap with the actuator unit, and having a flexible and insulative substrate, a plurality of connection terminals formed on the substrate, and signal lines formed on the substrate and drawn from the connection terminals respectively; wherein:

the land portions are electrically connected to the connection terminals, respectively; and three land portions, among the land portions, adjacent to one another in a short direction of the pressure chambers and on a signal-line drawn side at which the signal lines are drawn, are arranged to shift from one another in the longitudinal direction of the pressure chambers.

2. The head according to claim 1, wherein:

the pressure chambers form a plurality of pressure-chamber rows linearly aligned in a row-direction which is different from the longitudinal direction; and the land portions are arranged such that, a land portion, among the land portions, which is conducted to an individual surface electrode among the individual surface electrodes and corresponding to a pressure chamber forming a pressure-chamber row among the pressure-chamber rows and being on the signal-line drawn side, is arranged at a position shifted in the longitudinal direction from another land portion conducted to another individual surface electrode corresponding to another pressure chamber which is adjacent to the pressure chamber and which also forms the pressure-chamber row on the signal-line drawn side.

3. The head according to claim 2, wherein a length, in the longitudinal direction of the pressure chambers, of the electrode drawing portions is same among the electrode drawing portions.

4. The head according to claim 2, wherein:

the row-direction of the pressure chamber rows is orthogonal to the longitudinal direction of the pressure chambers; and a direction in which the signal lines are drawn is parallel to the longitudinal direction of the pressure chambers.

5. The head according to claim 1, wherein electrostatic capacitance of the electrode-drawing portions is same among the electrode-drawing portions.

6. The head according to claim 1, wherein:

the land portions form a plurality of land portion groups which are adjacent to each other and each of which includes land portions adjacent to one another; and an arrangement pattern, in which the land portions are arranged, is same among the land portion groups.

7. The head according to claim 6, wherein:

the electrode drawing portions, extending from the individual surface electrodes respectively, are parallel to one another; and the land portions, included in each of the land portion groups, are arranged along a straight line inclined with respect to the longitudinal direction of the pressure chambers.

8. The head according to claim 6, wherein:

the electrode drawing portions, extending from the individual surface electrodes, respectively, are parallel to one another;

the land portions included in each of the land portion groups are arranged one by one at a constant spacing distance in the longitudinal direction of the pressure chambers; and a spacing distance in the longitudinal direction of the pressure chambers is widest between land portions among the land portions and located at both ends, respectively, in each of the land portion groups, and remaining land portions, except for the land portions located at the both ends, are arranged to deviate from a straight line connecting the land portions located at the both ends in each of the land portion groups.

9. The head according to claim 6, wherein:

the land portions, included in each of the land portion groups, are arranged one by one at a spacing distance in the longitudinal direction of the pressure chambers; and the spacing distance is widest among land portions in a land portion group among the land portion groups and disposed on the signal-line drawn side.

10. The head according to claim 1, wherein:

the pressure chambers include color-designated pressure chambers to which a plurality of color inks are supplied respectively, the color inks including a black ink; and the black ink is supplied to a color-designated pressure chamber among the color-designated pressure chambers and corresponding to an individual electrode among the individual electrodes and being on the signal-line drawn side.

11. The head according to claim 1, wherein the cavity unit includes a plurality of metallic plates joined together by metal diffusion bonding.

12. The head according to claim 1, wherein the electrode drawing portions are arranged at positions overlapping with the manifold.

13. The head according to claim 1, wherein:

the actuator unit further includes inner electrodes formed above the pressure chambers, respectively, and piezoelectric sheets each formed on a surface of one of the inner electrodes; and each of the individual surface electrodes is formed on a surface of one of the piezoelectric sheets.

14. The head according to claim 1, wherein with respect to all of the land portions, three land portions among the land portions and adjacent to one another in the short direction of the pressure chambers are arranged to shift from one another in the longitudinal direction of the pressure chambers.

15. The head according to claim 1, wherein with respect to land portions among the land portions and on the signal-line drawn side, four land portions which are adjacent to one another in the short direction of the pressure chambers are arranged to shift from one another in the longitudinal direction of the pressure chambers.

16. The head according to claim 1, wherein the head include only one piece of the flexible cable.

17. A flexible cable connectable to an head for an ink-jet printer, the head including: a cavity unit including a plurality of nozzles, a plurality of elongated pressure chambers communicating with the nozzles respectively, and a manifold storing an ink to be supplied to the pressure chambers; and an actuator unit having individual surface electrodes which are formed corresponding to the pressure chambers, respectively, electrode-drawing portions which are drawn in a longitudinal direction of the pressure chambers, respectively and are conducted to the individual surface electrodes, respectively, and land portions which are conducted to the electrode-drawing portions, respectively, the actuator changing volume of the pressure chambers respectively, when driving signal is supplied to the individual surface electrodes, so as to discharge the ink from the nozzles, the flexible cable comprising:

a flexible and insulative substrate which is band-shaped;

a plurality of connection terminals which are formed on the substrate; and a plurality of signal lines formed on the substrate and drawn, in an extending direction in which the substrate extends, from the connection terminals respectively, the signal lines supplying driving signal to the individual surface electrodes respectively;

wherein three connection terminals, among the connection terminals, which are adjacent to one another in a direction different from the extending direction and arranged in the substrate on a signal-line drawn side at which the signal lines are drawn, are formed at positions shifted from one another in the extending direction.

18. The flexible cable according to claim 17, wherein each of the connection terminals is a copper-foil portion formed with a through hole at a center of the copper-foil portion.

19. An ink-jet printer which discharges an ink to perform recording on a recording medium, the ink-jet printer comprising:

a head for ink-jet printer which includes a cavity unit having a plurality of nozzles, a plurality of elongated pressure chambers communicating with the nozzles, respectively, and a manifold storing the ink to be supplied to the pressure chambers; an actuator unit which has individual surface electrodes formed corresponding to the pressure chambers, respectively, electrode-drawing portions drawn in a longitudinal direction of the pressure chambers, respectively and conducted to the individual surface electrodes, respectively, and land portions conducted to the electrode-drawing portions, respectively, the actuator changing volume of the pressure chambers respectively when driving signal is supplied to the individual surface electrodes so as to discharge the ink from the nozzles; and a flexible cable arranged to overlap with the actuator unit and having a flexible and insulative substrate, a plurality of connection terminals formed on the substrate, and signal lines formed on the substrate and drawn from the connection terminals, respectively;

a carriage which is movable while supporting the head for ink-jet printer; and a drive control unit which is connected to one end of the flexible cable, which supplies the driving signal to the individual surface electrodes, and which supplies a signal for controlling drive of the carriage to the carriage;

wherein the land portions are electrically connected to the connection terminals, respectively; and three land portions, among the land portions, which are adjacent to one another in a short direction of the pressure chambers and on a signal-line drawn side at which the signal lines are drawn, are arranged to shift from one another in the longitudinal direction of the pressure chambers.

20. The ink-jet printer according to claim 19, wherein the head includes only one piece of the flexible cable.

* * * * *